US011807031B1

(12) United States Patent
Parker et al.

(10) Patent No.: US 11,807,031 B1
(45) Date of Patent: Nov. 7, 2023

(54) OPERATING MECHANISM FOR WRITING IMPLEMENT

(71) Applicant: Big Idea Design LLC, Chattanooga, TN (US)

(72) Inventors: Chadwick Sterling Parker, Chattanooga, TN (US); Zheng Huang, Chattanooga, TN (US)

( * ) Notice: Subject to any disclaimer, the term of this patent is extended or adjusted under 35 U.S.C. 154(b) by 0 days.

(21) Appl. No.: 17/823,378

(22) Filed: Aug. 30, 2022

(51) Int. Cl.
*B43K 24/08* (2006.01)

(52) U.S. Cl.
CPC ..... *B43K 24/08* (2013.01)

(58) Field of Classification Search
CPC ..... B43K 24/02; B43K 24/08; B43K 24/088
USPC ..... 401/113–114
See application file for complete search history.

(56) References Cited

U.S. PATENT DOCUMENTS 2,427,069 A * 9/1947 Randolph ..... B43K 24/08 401/141
2,428,854 A * 10/1947 Randolph ..... B43K 24/08 401/113
2,580,753 A * 1/1952 Frentzel ..... B43K 24/08 401/112
2,921,557 A * 1/1960 Nuss ..... B43K 24/08 401/105
2,928,373 A * 3/1960 Esterow ..... B43K 24/08 401/114
8,100,598 B2 * 1/2012 Killion ..... B43K 24/02 401/100

* cited by examiner

*Primary Examiner* — David P Angwin
*Assistant Examiner* — Bradley S Oliver
(74) *Attorney, Agent, or Firm* — Squire Patent Consulting & IP Law LLC; Brendan E. Squire

(57) ABSTRACT

An apparatus and method for operating a writing implement and an operating mechanism for the same. The writing implement has an extensible and retractable writing cartridge carried within a body of the writing implement. The operating mechanism includes an carrier for selectively extending a tip of the writing cartridge from the body. A release button is operable from each side of the body for releasing the carrier from a locked condition in which the writing cartridge is retained in the extended position and a release condition permitting retraction of the writing cartridge into the body. The operating mechanism includes a carrier with a recess to slidably receive the release button and a yoke spring to urge the release button to a centered position. In the locked position, a base of a first tab on the carrier is urged in subjacent abutment with a second tab on the release button.

10 Claims, 4 Drawing Sheets

OPERATING MECHANISM FOR WRITING IMPLEMENT

BACKGROUND OF THE INVENTION

The present invention relates to writing implements with extensible and retractable ink cartridges and, more particularly to operating mechanisms for such writing implements.

Most conventional extensible cartridge writing implements, such as ink pens, have an activation button that is operable to position the cartridge between an extended and locked position and a retracted position Other extensible cartridge writing implements may have a side release button that is actuated to release the cartridge from an extended position and retract the cartridge into the body of the writing implement. These configurations limit the user's ability to retract the writing cartridge, particularly left-handed users, as the side release buttons are typically configured for right-handed users.

As can be seen, there is a need for an improved writing implement and operating mechanism that permits the user to retract the writing cartridge by activation of a release button on either side of the writing implement.

SUMMARY OF THE INVENTION

In one aspect of the present invention, a writing implement is disclosed. The writing implement includes a body having a proximal end, a distal end, and an interior cavity defined within the body. A first aperture and a second aperture are defined through a sidewall of the proximal end of the body. A carrier is dimensioned to be received within the interior cavity. The carrier has a pin at a top end, a first tab aligned with an axial centerline of the carrier, a recess defined transversely across the axial centerline of the carrier, and a base at a bottom end of the carrier. A release button is dimensioned to be slidably received within the recess. The release button having an operating pad at each end of the release button. The operating pad is dimensioned to extend through the first aperture and the second aperture. A second tab is disposed at an intermediate position of the release button between the first pad and the second pad. A yoke spring element has a collar with an opening that is configured to be received over the pin. A first resilient leg and a second resilient leg distend from the collar. Each of the first resilient leg and the second resilient leg engage with an inner face of the operating pads to bias the release button to a centered position.

In another aspect of the invention, an operating mechanism for selectively extending and retracting a writing cartridge from and interior cavity of a body a writing implement is disclosed. The operating mechanism includes a carrier having a pin at a top end, a first tab aligned with an axial centerline of the carrier, a recess defined transversely across the axial centerline of the carrier, and a base at a bottom end of the carrier. The carrier is received within a proximal end of the body of the writing implement. The carrier is operable between an extended position and a retracted position. In in the extended position a tip of the writing cartridge is urged from the distal end of the body. In the retracted position, the cartridge is contained within the interior cavity. A release button is slidably carried within the recess and is operable from each of a first side and a second side to selectively position the release button between a locked condition and a release condition. A yoke spring element is coupled with the release button to bias the release button to a centered position. In the extended position, a base of the first tab is positioned distal to a base of the second tab and the bias of the yoke spring positions the base of the second tab in axial alignment with the base of the first tab. An abutment of the base of the first tab with the base of the second tab defines the locked condition to retain the tip of the writing cartridge in the extended position.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an improved apparatus and method for operating a writing implement and an operating mechanism for the writing implement, such as an ink pen, having a selectively extensible and retractable writing cartridge carried within a body of the writing implement. The operating mechanism includes an carrier for selectively extending the writing cartridge from the body of the writing implement. A first release button and a second release button are each operable from a side of the body of the writing implement for activating a retraction of the writing cartridge into the body of the writing implement.

As seen in reference to the drawings of FIGS. 1-9, the writing implement includes a body having a proximal end and a distal end. The proximal end contains the operating mechanism, and a writing end of the writing cartridge 32 is selectively extensible from the distal end. A spring 34 is carried within the distal end to bias the writing cartridge 32 towards the proximal end of the body. The body may include an upper body segment 28 and a lower body segment 26 that are releasably coupled to each other at an intermediate portion of the body, such as by a cooperating thread. Each of the upper body segment 28 and the lower body segment 26 define an interior cavity of the writing implement.

Figure 1:
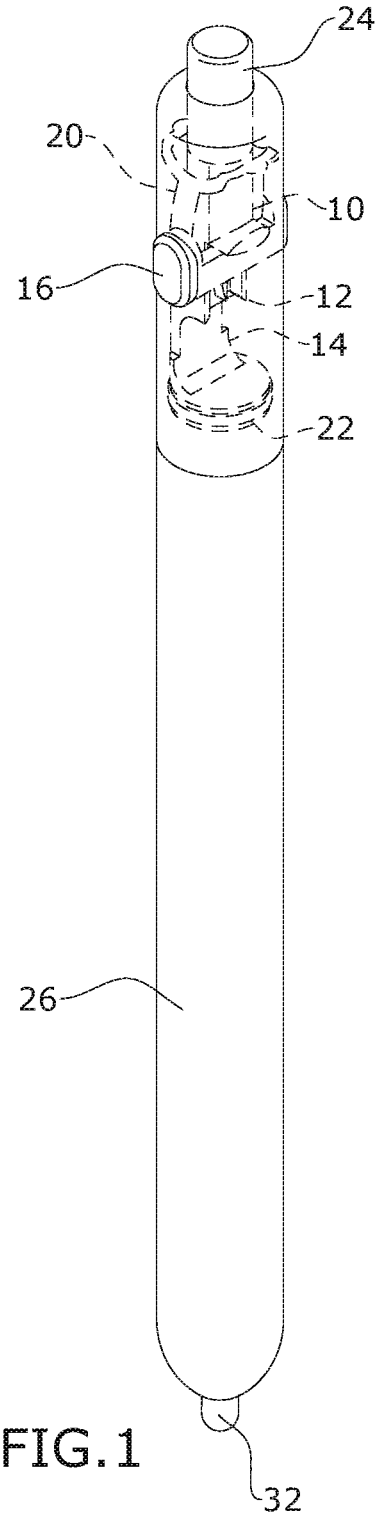
FIG. 1 is a perspective view of the operating mechanism for a writing implement with an marking cartridge in an extended position.
Figure 2:
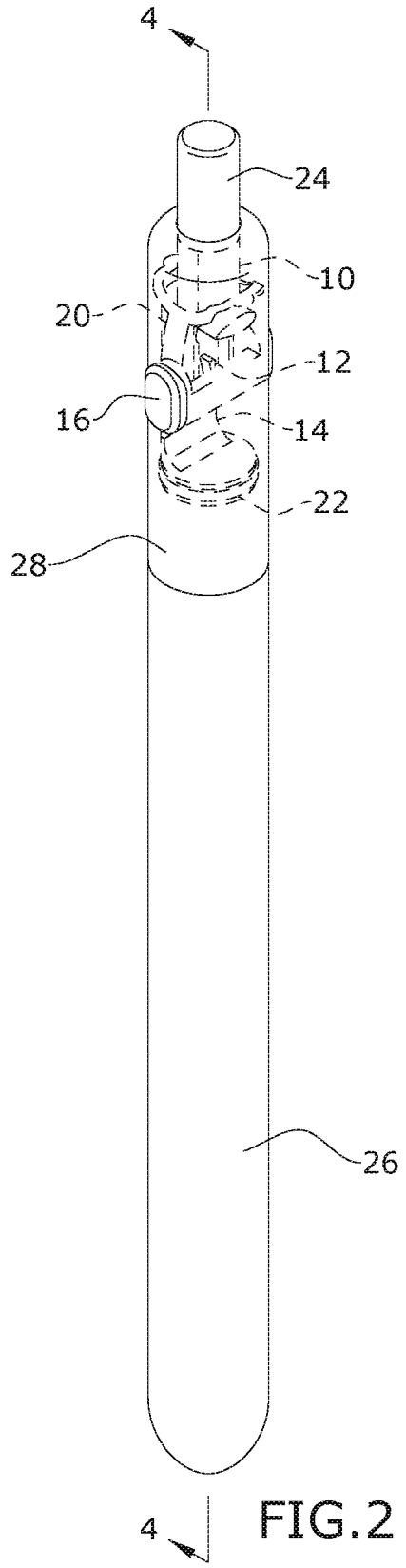
FIG. 2 is a perspective view of the operating mechanism for the writing implement with the marking cartridge in a retracted position.
Figure 3:
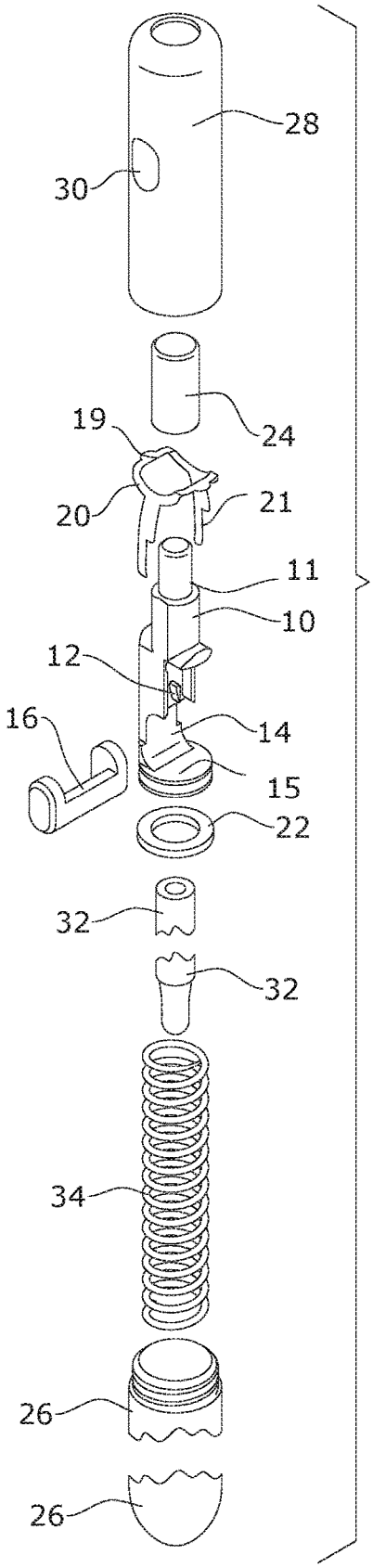
FIG. 3 is an exploded view of the operating mechanism.
Figure 4:
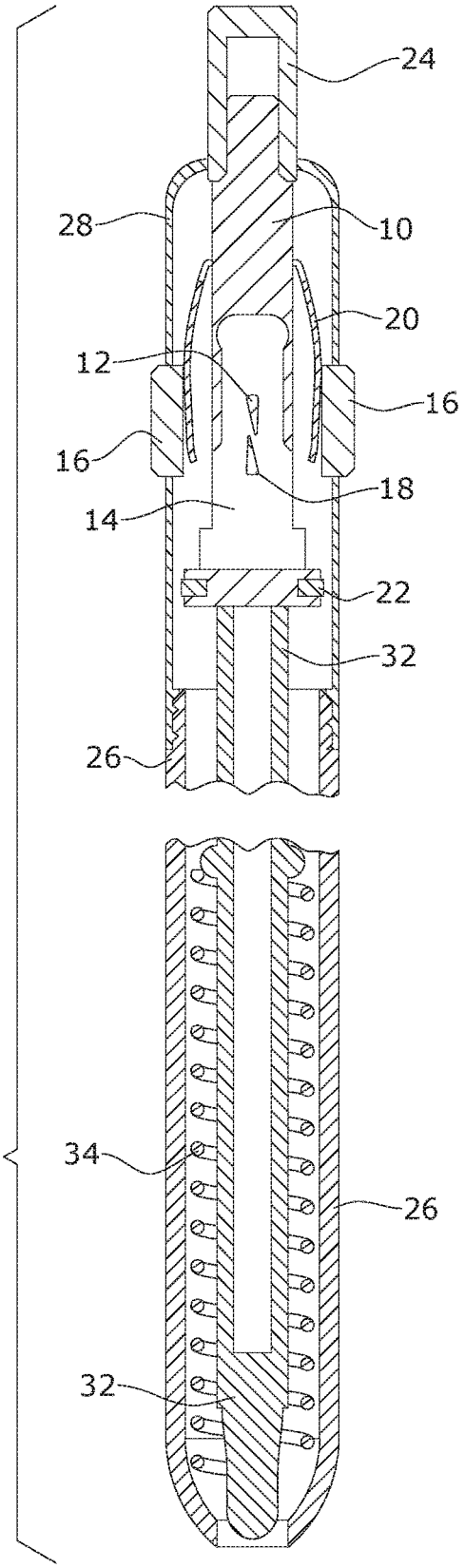
FIG. 4 is a section view of the operating mechanism, taken along line 4-4 in FIG. 2.

As best seen in reference to FIG. 3, the operating mechanism includes a carrier 10 that is dimensioned to be received within the interior cavity of the upper body segment 28. The carrier 10 has a pin 11 extending from a top end of the carrier 10 along an axial centerline of the carrier 10. A pin cap 24 may be provided to cover the pin 11. A first locking tab 12 protrudes from an intermediate position of the carrier 10 and is aligned along the axial centerline. The first locking tab 12 may be formed in a geometric shape having a base oriented towards the proximal end of the writing implement, and sidewalls oriented away from the proximal end. In the embodiment shown, the geometric shape is a triangular shape, with a base of the triangle oriented towards the proximal end of the writing implement, and an apex of the triangle oriented towards the distal end of the writing implement.

A recess 14 is formed transversely across the axial centerline of the carrier 10 subjacent to the first locking tab 12. The recess 14 is dimensioned to slidably receive a release button 16 having an operating pad disposed on opposed sides of the release button 16. A second locking tab 18 protrudes from an intermediate position of the release button 16. The second locking tab 18 may also be formed in a geometric shape, such that a base of the geometric shape is oriented towards the distal end of the writing implement and sides of the geometric shape oriented towards the proximal end. In the embodiment shown, the geometric shape is a triangle. The operating pads extend through an aperture 30 defined in opposed sides of the upper body segment 28.

A yoke spring element 20 has a collar 19 having a central opening that is received over the pin 11. The yoke spring element 20 has resilient legs 21 distending from the collar 19. When assembled, the resilient legs 21 engage with an inner face of the operating pads of the release button 16 to bias the release button to a centered position.

A base 15 is disposed at a bottom end of the carrier 10. The base 15 may be formed as a disc shape that is dimensioned to be received within interior cavity of the upper body segment 28. A bushing 22 may be applied to surround the base 15 to facilitate sliding of the carrier 10 within the interior cavity of the upper body segment 28. A bottom surface of the base 15 engages with a top end of the writing cartridge 32 to urge the writing cartridge 32 towards the distal end of the writing implement against the bias of the spring 0.34

Figure 5:
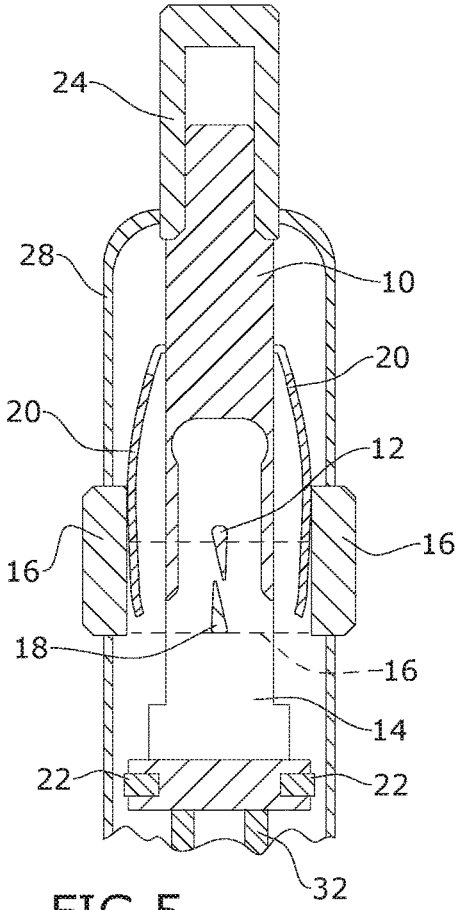
FIG. 5 is a detailed section view of the operating mechanism in an unlocked condition.

Operation of the operating mechanism is shown in reference to the drawings of FIGS. 5-9. As seen in FIG. 5 the operating mechanism in an unlocked condition with the writing cartridge 32 retracted within the body. The first tab 12 of the carrier 10 is positioned above the second tab 18 of the release button 16, with the release button 16 laterally offset from the axial centerline of the carrier 10.

Figure 6:
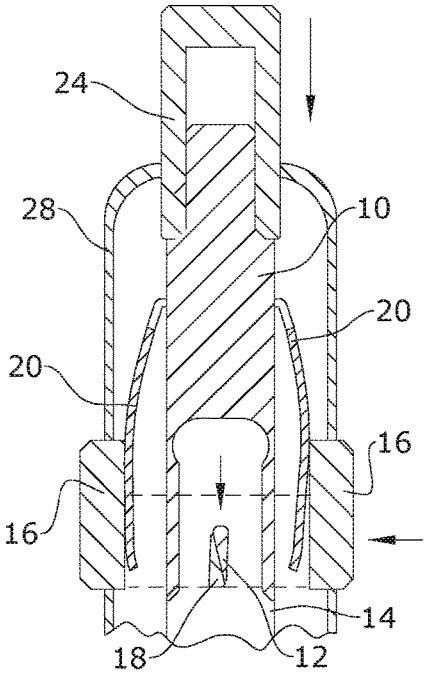
FIG. 6 is a detailed section view of the operating mechanism being activated to extend the ink cartridge.
Figure 7:
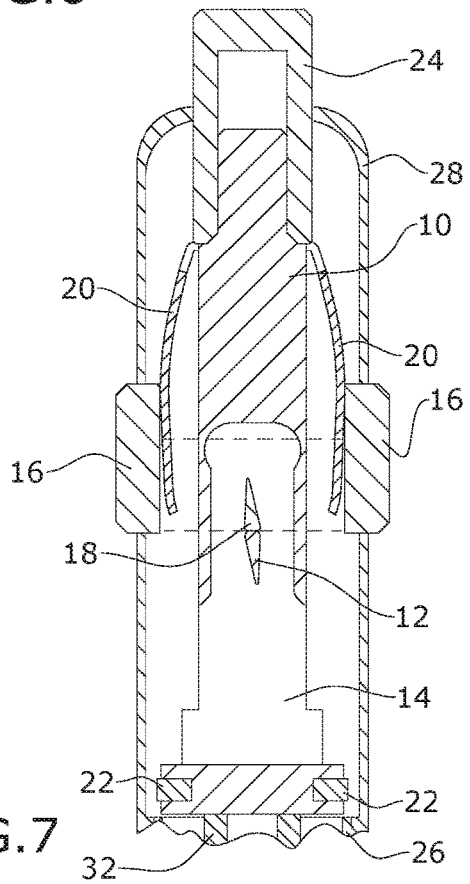
FIG. 7 is a detailed section view of the operating mechanism in a locked condition.

To extend the writing cartridge 32, the user would depress the pin cap 24 which urges the carrier 10 towards the distal end of the writing implement, as seen in FIG. 6. As the carrier 10 moves towards the distal end, the first tab 12 and the second tab 18 approach each other along the axial centerline of the carrier 10. The triangular shapes of the first tab 12 and the second tab 18, with the apexes oriented towards one another, permits the engagement of lateral sides of the first tab 12 and the second tab 18, such that as the carrier is urged downwardly, the release button 16 is urged laterally.

Continued depression of the pin cap 24 urges the carrier 10 such that the first tab 12 passes the second tab 18 within the upper body 28. When the base of each of the first tab 12 and the second tab 18 reversed their initial dispositions, the resilient legs of the yoke spring element 20 urges the second tab 18 towards a centered position aligned with the axial centerline such the base of the first tab 12 and the second tab 18 are positioned in mating abutment, with the operating mechanism in the locked condition, as best seen in reference to FIG. 7. With the operating mechanism in the locked condition, the writing cartridge is locked in the extended position.

Figure 8:
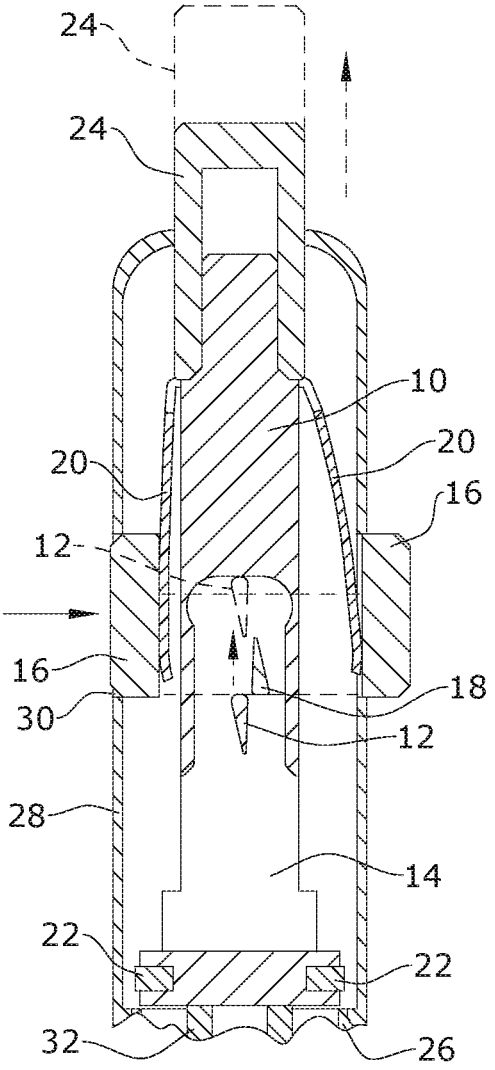
FIG. 8 is a detailed section view of the operating mechanism showing a releasing from the locked condition a first side.
Figure 9:
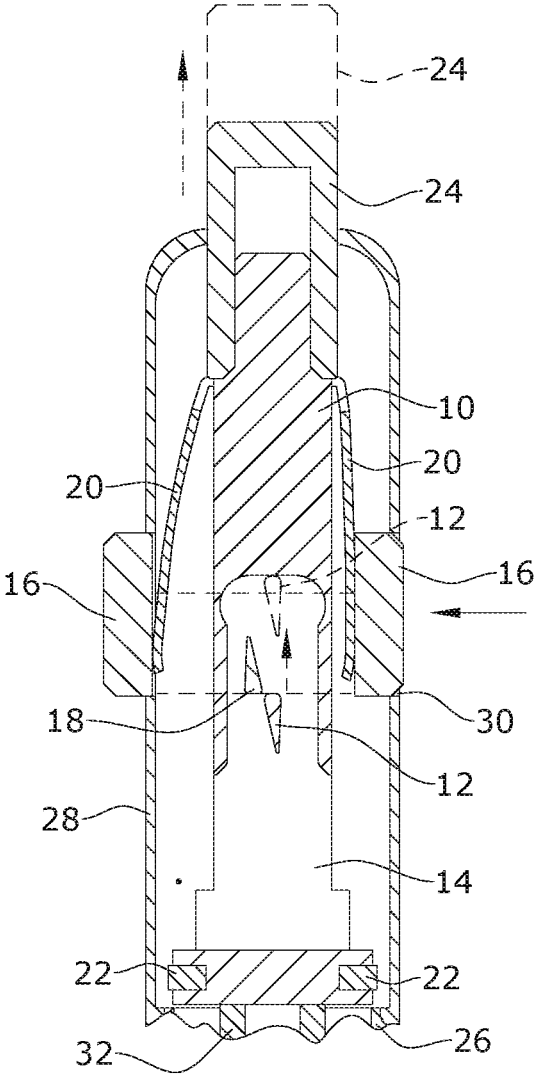
FIG. 9 is a detailed section view of the operating mechanism showing a releasing from the locked condition from a second side.

The release button 16 may then be actuated from either the first side or the second side of the writing implement to retract the writing cartridge 32 into the interior cavity of the body. As seen in FIG. 8, depression of the first side of the release button 16 laterally displaces the second tab 18 such that the base of the second tab 18 is clear of the base of the first tab 12. Likewise, as seen in reference to FIG. 9, depression of the second side of the release button 16 operates the second tab 18 in the opposite direction. When the bases of the first tab 12 and the second tab 18 are no longer in abutment, the bias of spring 34 operates to retract the writing cartridge 32 within the interior cavity of the body of the writing implement.

As can be seen, the release mechanism of the present invention permits the user to selectively retract the writing cartridge 34 by operation of the release button 16 from either side of the pen body.

It should be understood, of course, that the foregoing relates to exemplary embodiments of the invention and that modifications may be made without departing from the spirit and scope of the invention as set forth in the following claims.

What is claimed is:

1. A writing implement, comprising:

a body having a proximal end, a distal end, an interior cavity defined within the body, a first aperture and a second aperture defined through a sidewall of the proximal end of the body;

a carrier dimensioned to be received within the interior cavity, the carrier having a pin at a top end, a first tab aligned with an axial centerline of the carrier, a recess defined transversely across the axial centerline of the carrier, and a base at a bottom end of the carrier;

a release button dimensioned to be slidably received within the recess, the release button having an operating pad at each end of the release button, the operating pad dimensioned to extend through the first aperture and the second aperture, and a second tab disposed at an intermediate position of the release button between the operating pads; and a yoke spring element having a collar with an opening that is configured to be received over the pin, a first resilient leg and a second resilient leg distending from the collar, each of the first resilient leg and the second resilient leg engage with an inner face of the operating pads to bias the release button to a centered position.

2. The writing implement of claim 1, further comprising:

a writing cartridge carried within the interior cavity of the body; and a spring received within the interior cavity of the body configured to bias the writing cartridge in abutment with the base of the carrier.

3. The writing implement of claim 1, wherein the carrier is operated by a depression of the pin to urge the carrier towards the distal end of the body.

4. The writing implement of claim 1, wherein the release button is operable between a locked condition and a release condition, wherein in the locked condition, the yoke spring element centers the base of the second tab in superjacent abutment with a base of the first tab.

5. The writing implement of claim 4, wherein a depression of the pin, the base of the carrier is operable to urge a tip of a writing cartridge from the distal end of the body of the writing implement.

6. The writing implement of claim 5, wherein with the depression of the pin, a side edge of the first tab slidably abuts with a side edge of the second tab to urge the second tab from the centered position.

7. An operating mechanism for selectively extending and retracting a writing cartridge from and interior cavity of a body a writing implement, comprising:

a carrier having a pin at a top end, a first tab aligned with an axial centerline of the carrier, a recess defined transversely across the axial centerline of the carrier, and a base at a bottom end of the carrier, the carrier received within a proximal end of the body of the writing implement, the carrier operable between an extended position and a retracted position, wherein in the extended position a tip of the writing cartridge is urged from a distal end of the body, and in the retracted position, the writing cartridge is contained within the interior cavity;

a release button slidably carried within the recess, the release button having a second tab, the release button operable from each of a first side and a second side to selectively position the second tab between a locked condition and a release condition;

a yoke spring element coupled with the release button to bias the release button to a centered position; and in the extended position, a base of the first tab is positioned distal to a base of the second tab and the bias of the yoke spring element positions the base of the second tab in axial alignment with the base of the first tab, wherein an abutment of the base of the first tab with the base of the second tab define the locked condition to retain the tip of the writing cartridge in the extended position.

8. The operating mechanism of claim 7, the first tab further comprising:

a first geometric shape with the base of the first geometric shape oriented towards the proximal end.

9. The operating mechanism of claim 8, the second tab further comprising:

a second geometric shape with the base of the second geometric shape oriented towards the distal end.

10. The operating mechanism of claim 9, wherein the first geometric shape and the second geometric shape are triangular.

* * * * *